United States Patent [19]

Blaudszun

[11] 4,411,075

[45] Oct. 25, 1983

[54] PROCESS AND APPARATUS FOR DRYING OF SOLVENT CONTAINING MATERIAL

[75] Inventor: Bernd Blaudszun, Melsbach, Fed. Rep. of Germany

[73] Assignee: Lohmann GmbH & Co. KG, Neuwied, Fed. Rep. of Germany

[21] Appl. No.: 311,435

[22] Filed: Oct. 14, 1981

[30] Foreign Application Priority Data

Oct. 14, 1980 [DE] Fed. Rep. of Germany ..... 3038791

[51] Int. Cl.[3] ..... F26B 3/04

[52] U.S. Cl. ..... 34/32; 34/41; 34/77; 34/242; 432/242; 68/5 E

[58] Field of Search ..... 34/32, 242, 77, 155, 34/41, 27; 432/242; 68/5 E

[56] References Cited

U.S. PATENT DOCUMENTS

| | | | |
|---|---|---|---|
| 2,299,145 | 10/1942 | Hill et al. | 34/242 |
| 3,186,698 | 6/1965 | Thome | 34/242 |
| 3,467,366 | 9/1969 | Westeren et al. | 263/6 |
| 3,706,138 | 12/1972 | Schuierer | 34/16 |
| 3,783,649 | 1/1974 | Yamamoto et al. | 68/5 E |
| 3,909,953 | 10/1975 | Hemsath et al. | 34/26 |
| 3,927,540 | 12/1975 | Tanaka et al. | 68/5 E |
| 3,931,684 | 1/1976 | Turnbull et al. | 34/242 |
| 4,150,494 | 4/1979 | Rothchild | 34/28 |

*Primary Examiner*—L. I. Schwartz

*Attorney, Agent, or Firm*—Webb, Burden, Robinson & Webb

[57] ABSTRACT

A process for drying solvent containing material is disclosed. The solvent containing material is passed through a drying chamber containing an inert gas. Inert gas is introduced into at least one lock chamber preceding and/or following the drying chamber. An annular flow of inert gas is produced in the lock chamber. A minor amount of the inert gas required for drying the material is jetted into the lock chamber proximate to the inlet and/or outlet opening of the drying chamber and a mixture of inert gas and sucked-in external air being discharged from the lock chamber in the peripheral region of the annular flow. The major portion of the inert gas is introduced directly into the drying chamber. An apparatus for practicing the invention is also disclosed.

14 Claims, 2 Drawing Figures

PROCESS AND APPARATUS FOR DRYING OF SOLVENT CONTAINING MATERIAL

BACKGROUND OF THE INVENTION

1. Field of the Invention

This invention relates to a process and an apparatus for drying solvent containing material.

2. Description of the Prior Art

A process and an apparatus for drying solvent containing material are known from U.S. Pat. No. 4,150,494, in which a conveyor supporting the solvent containing material to be dried by evaporation, is conducted through a drying chamber containing inert gas (nitrogen), the drying chamber is bounded on both sides by lock chambers. The inert gas is introduced through the lock chambers. The major part of the inert gas stream flows into the drying chamber and is laden with solvent vapors therein. After leaving the drying chamber, solvent vapors are removed from the inert gas by cooling in a heat exchanger and the inert gas is discharged to the atmosphere. The minor part of the inert gas flows out of the lock chamber directly into the atmosphere and has the function of preventing air which contains oxygen from entering the drying chamber.

It was found that in such a process entry of atmospheric oxygen into the drying chamber and exit of inert gas laden with solvent vapors into the atmosphere cannot be completely prevented. Entry of atmospheric oxygen is particularly undesirable when the inert gas stream containing the solvent vapors is to be returned to the drying chamber, since there occurs a constant enrichment of atmospheric oxygen so that when inflammable solvents are used, the explosion limits can be reached or exceeded. In addition, exit of solvent vapors into the atmosphere is undesirable because of the economic losses entailed and because of environmental pollution.

An object of the present invention is to provide a process and an apparatus for drying solvent containing material and enabling exit of solvent vapors from and preventing entry of air into, a drying chamber containing inert gas and through which a solvent containing material is passed.

This object and others is achieved in accordance with the invention.

BRIEF DESCRIPTION OF THE INVENTION

In the process of the invention, the solvent containing material to be dried is conducted through a drying chamber containing an inert gas. The inert gas is introduced into at least one lock chamber preceding and/or following the drying chamber. The process according to the invention is characterized in that an annular flow of inert gas is produced in the lock chamber or chambers. A minor amount of the inert gas required for drying the material is jetted proximate to the inlet and/or outlet opening of the drying chamber, into the lock chamber and a mixture of inert gas and sucked-in external air being discharged from the lock chamber. The major part of the inert gas is introduced directly into the drying chamber.

The apparatus according to the invention for carrying out the process in accordance with the invention contains a conventional drying chamber having an inert gas therein. The chamber has inlet and outlet openings for passing material to be dried therethrough and at least one lock chamber preceding and/or following the drying chamber and devices for introduction of inert gas into the chamber. The apparatus in accordance with the invention is characterized in that the lock chamber (s) have at least one slot nozzle arranged in proximity to the inlet or outlet opening of the drying chamber for jetting in a small portion of the inert gas required for drying the solvent containing material, and also at least one opening arranged in the peripheral region of the annular flow produced, for discharging a mixture of inert gas and sucked-in atmospheric air; and the drying chamber is provided with inlet and outlet ducts for the major portion of the inert gas.

According to the invention, any solvent containing material can be dried. For example, the invention can be applied in the production of flat adhesive material in which an adhesive is applied to paper or textile lengths or tapes. Such tapes can, for example, be used as technical adhesive tapes or as tapes or lengths for medical purposes (e.g., sticking plaster). For application of the adhesive to the paper or textile length it is brought to a flowable state with a liquid organic solvent, so that it can be applied in sufficiently thin and uniform layers. The solvent evaporates on drying. The material to be dried remains, for a predetermined time governed by the volatility and amount of organic solvent, in a drying chamber in contact with the inert gas which takes up the solvent vapors.

As a rule solvents or mixtures of solvents are used which have inflammable vapors. In this case it is necessary to use an inert gas with an oxygen content below the ignition limits of the solvent vapor. Inert gases such as nitrogen or carbon dioxide are used. However, the oxygen content of air can be reduced by admixture of an inert gas to the extent that the ignition limits are no longer reached. In certain cases it is also possible to use combustion gases with a low oxygen content.

However, the inflammability of the orgnic solvent vapors is not only a function of the oxygen content in the carrier gas, but also depends on the concentration and nature of the solvent vapor. Thus the danger of ignition is greater, for example, with low-boiling hydrocarbons and ethers than with halogenated hydrocarbons. The ignition properties of various solvent vapors are however known, and the permissible solvent vapor concentrations and oxygen contents can be taken from the literature or determined by simple tests known to those skilled in the art.

By means of the process and apparatus according to the invention, both the exit of solvent vapors into the atmosphere and the penetration of atmospheric oxygen into the drying chamber are prevented. These results are accomplished by means of the permanent annular flow produced in the lock chamber (s) and which can also be termed as an inert gas vortex. This annular flow is produced by cooperation of the slot nozzle arranged in proximity to the inlet or outlet opening of the drying chamber with the suction openings arranged in the peripheral region of the annular flow. Although external air is sucked in by the annular flow through the inlet or outlet openings of the lock chamber, it remains in the peripheral region of the annular flow and is sucked out together with the inert gas. Because of the annular flow circulating in it, the lock chamber becomes a barrier zone. A constant pressure ratio between lock chamber and drying chamber being set which prevents exit of the inert carrier gas laden with solvent vapors from the drying chamber into the atmosphere.

Losses of inert gas can be kept very low by the jetting of the inert gas stream into the lock chamber with the formation of an annular flow. It was found, for example, that the inert gas loss could be reduced to less than 10 percent in comparison with an arrangement in which the inert gas was introduced simply, without formation of an annular flow, into a lock chamber preceding the drying chamber.

The apparatus according to the invention can contain a lock chamber preceding or following the drying chamber. On the entry side of the drying chamber, the inert gas flows from the slot nozzle first in the opposite direction to the transport direction of the material to be dried, then sweeps along the walls of the lock chamber and is sucked out together with the sucked-in external air, through an opening in the wall of the lock chamber, an annular flow being produced. The suction opening is preferably arranged such that the inert gas follows along a path in the peripheral region of the annular flow.

In the lock chamber arranged at the exit end of the drying chamber, the inert gas flows out of the slot nozzle first in the transport direction of the material, which has meanwhile been dried, agains sweeps along the walls of the lock chamber, and is likewise sucked out, so that an annular flow is again formed.

Because of the effectiveness of the annular flow, only a small portion of the inert gas required for drying the material needs to be introduced into the lock chamber, i.e., the major portion of the inert gas can be directly introduced into the drying chamber. The process according to the invention is particularly applicable in plants in which the solvent is recovered. In this aspect of the invention the procedure is such that the major portion of the inert gas is removed from the drying chamber after having become laden with solvent vapors and, after removal of the solvent vapors, is conducted back again into the drying chamber. The solvent vapors can, for example, be removed by condensation or adsorption. If atmospheric oxygen were to penetrate into the drying chamber in such a solvent recovery plant in which the inert gas is conducted in a circuit, a constant enrichment of the atmospheric oxygen would take place, so that the explosion limits would soon be reached. Exclusion of atmospheric oxygen is thus very important in this case.

In the process according to the invention, the volume ratio between the inert gas jetted into the lock chamber and the sucked-in atmospheric air can be varied within wide limits by changing the size of the inlet or outlet openings in the lock chamber or in the drying chamber and/or changing the setting angle of the slot nozzle. Preferably, the ratio is set to about 1:1 through 1:400, preferably to about 1:200.

Any solvent containing material can be dried by means of the apparatus according to the invention. For example, the material can be conducted through the drying chamber in the form of a self-supporting strip, without other supporting devices. However, the material to be dried is preferably arranged on a conveyor belt conducted through the lock chamber (s) and the drying chamber. The inlet and outlet openings of the drying chamber and the lock chamber (s) being slit-shaped, with adjustable slit width. For example, a flat adhesive material is exemplified, as previously discussed.

A material with large height dimensions can however also be dried, in which case the inlet or outlet openings can of course no longer be made slit-shaped.

In the preferred form of embodiment of the apparatus according to the invention, in which a flat material is dried, the ratio between the width of the inlet or outlet slit of the drying chamber and the width of the inlet or outlet slit of the lock chamber is appropriately about 1:0.20 through 1:5, preferably about 1:0.3 through 3. Furthermore, according to a preferred embodiment, the slot nozzle can be adjustable to a setting angle between 5 and 90°. The width of the slot nozzle is appropriately adjustable between about 0.01 and 2 mm. Furthermore, the ratio of the distances between the length of material and the opening of the slot nozzle and half the width of the inlet or outlet slit of the drying chamber or half the width of the inlet or outlet slit of the lock chamber is appropriately about 5 through 15:5 through 15:1, preferably about 10:10:1.

The most favorable volume ratio between the jetted-in inert gas and the sucked-in atmospheric air can be set in a simple manner by means of these apparatus; this is important in relation to preventing both exit of solvent vapors and entry of atmospheric oxygen into the drying chamber.

To avoid larger pressure differences between the drying chamber and the lock chamber, flow resistances are preferably arranged in the inlet and/or outlet region of the drying chamber. The ratio of the distances between the length of material and the boundaries of the flow resistances facing the length of material and between the length of material and the slot nozzle opening, is preferably about 1 through 5:1.

The invention is described below with reference to the drawings.

Figure 1:
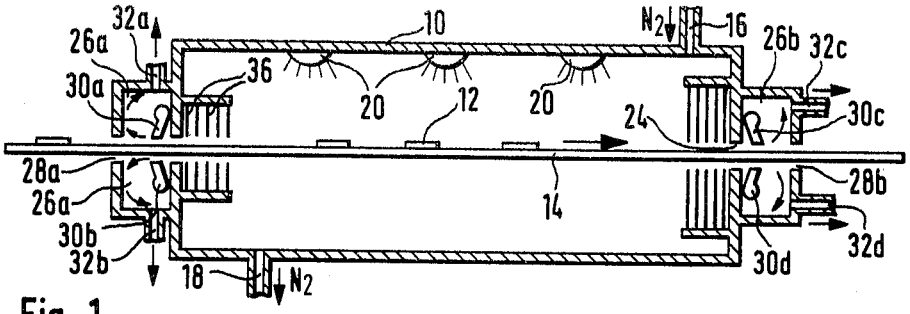
FIG. 1 is a schematic overall view of the apparatus according to the invention.

The material 12 to be dried, shown in the form of flat articles, is passed through on a conveyor 14. The conveyor can be an endless conveyor belt which circulates on rollers or the like (not shown). It can likewise be a carrier material which passes, freely suspended, through the drying chamber.

The major part of the inert gas (denoted $N_2$) is introduced into the drying chamber 10 at inert gas inlet 16. The inert gas becomes laden with solvent vapors in the drying chamber and is removed at outlet 18 from the drying chamber. The inert gas can then be freed from solvent vapors in a separate solvent recovery plant and can be conducted back to inlet 16 and into the drying chamber again.

The drying chamber is preferably heated for removal of the solvent from the material 12. For example, the roof radiators 20 can be used for this purpose. However, heating elements can also be provided beneath the conveyor path. The temperature in the drying space depends on the material to be treated and the solvent used, among other things. Further factors which influence the drying of the material are, among other things, the length of the drying chamber, the speed of the conveyor path, and the amount of inert gas introduced. However, these parameters are known to those skilled in the art.

Figure 2:
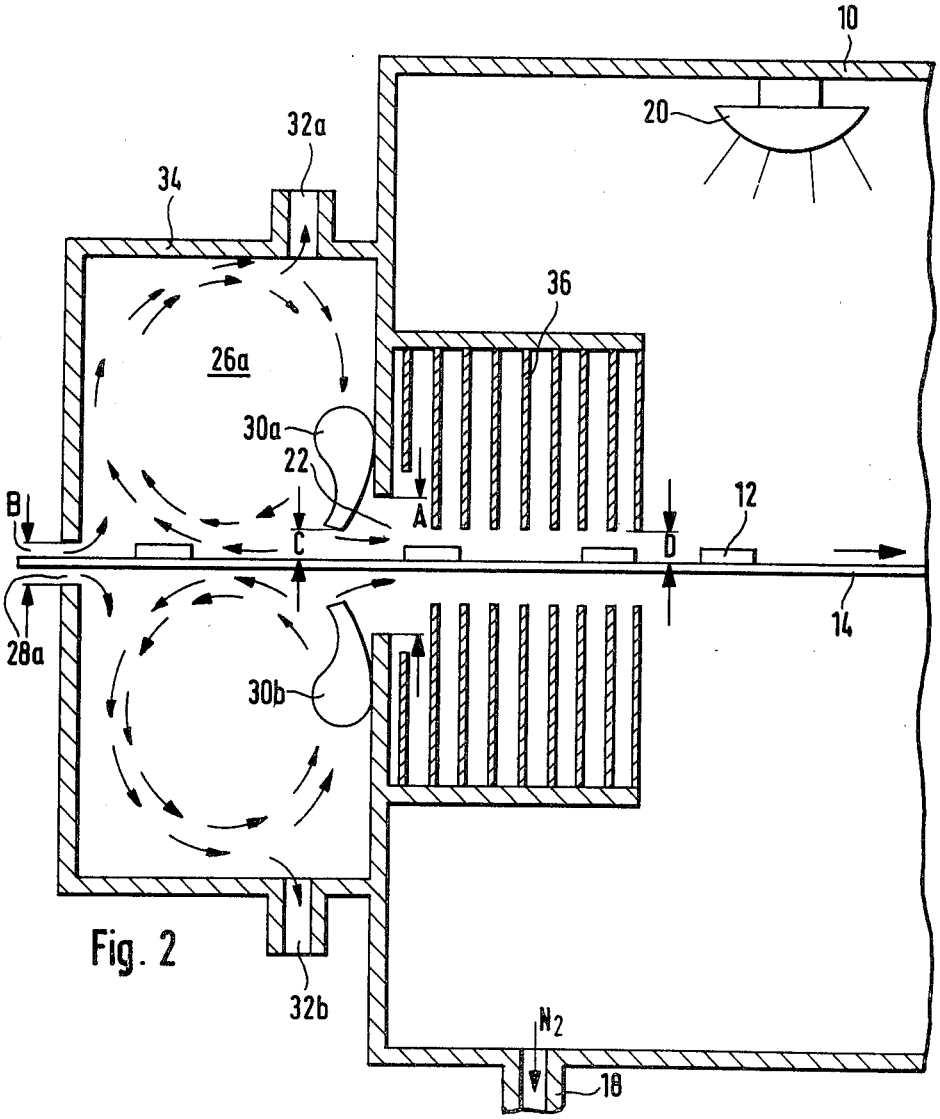
FIG. 2 is an enlarged partial schematic view (in section) of the input end of the apparatus according to the invention.

The material 12 to be dried enters the drying chamber 10 through the preferably slit-shaped entry opening 22. The slit width, winch is referenced as A in FIG. 2, is adjustable. At the other end, the dried material leaves again on the conveyor path 14 through the outlet opening 24 (as shown in FIG. 1).

A lock chamber 26*a* precedes the drying chamber 10, and a further lock chamber 26*b* follows it. The entry opening to the lock chamber 26*a* is denoted 28*a* and the entry opening to lock chamber 26*b* is denoted 28*b* (as shown in FIG. 1). Both openings are slit-shaped, their slit width, denoted by B in FIG. 2, is adjustable.

The slot nozzles 30 are arranged in the lock chambers 26*a* or 26*b*, and in fact slot nozzles 30*a* and 30*b* are in the upper or in the lower part of the lock chamber 26*a*, while slot nozzles 30*c* and 30*d* are in the upper or lower part of lock chamber 26*b*. The setting angle of the slot nozzles 30 is adjustable between 5 and 175° to the length of material. The slit width of the slot nozzles 30 is adjustable between about 0.01 and 2 mm. The distance between the opening of the slot nozzle 30*a* and the length of material 14 is denoted by C in FIG. 2. This distance is adjustable. The same correspondingly holds for the distance between the opening of slot nozzle 30*b* and the lower surface of the conveyor path 14 and also for the slot nozzles 30*c* and 30*d* in lock chamber 26*b* (as shown in FIG. 1).

The ratio of C, A/2 and B/2 is appropriately adjustable within the ratios 5 through 15:5 through 15:1, preferably about 10:10:1.

A suction opening 32*a* is provided in the roof wall 34 of lock chamber 26*a*, and in fact proximate of the end wall of drying chamber 10. A corresponding suction opening 32*b* is provided in the floor wall of the lock chamber 26*a*. The corresponding suction openings 32*c* and 32*d* for lock chamber 26*b* are indicated on the end wall of lock chamber 26*b*.

If an inert gas stream is jetted through the slot nozzles 30, an annular flow is formed in lock chambers 26 in a direction shown in FIG. 2 by the small arrows. The annular flow in the upper part of lock chamber 26*a* goes clockwise, and in fact counter to the direction of transport of the conveyor path 14. The annular flow in the lower part of the lock chamber goes counterclockwise and also counter to the transport direction of the conveyor belt 14. In the lock chamber 26*b* arranged at the outlet end of the drying chamber, the annular flows go in the opposite direction, i.e., the annular flow in the upper part of lock chamber 26*b* moves counterclockwise, while the annular flow in the lower part moves clockwise.

The annular flow in the upper part of lock chamber 26*a* then turns upwards, and some external air is sucked in through the inlet opening but however remains in the peripheral region of this annular flow. The annular flow then sweeps along the roof wall 34 of the lock opening and is sucked out through opening 32*a*. The action of the annular flow is greatest when the gas flowing out from the slot nozzle takes the longest path in the peripheral region, i.e., it is more favorable if the suction opening 32*a* is arranged in the roof wall 34, and in fact as near as possible to the end wall of the drying chamber 10, than if, for example, it were arranged at the end wall of the lock chamber 26*a*, as indicated in FIG. 1 analogously with respect to suction openings 32*b* and 32*d*. These are located in the end wall of lock chamber 26*b*.

To improve pressure equalization between drying chamber 10 and lock chambers 26*a* or *b*, flow resistances 36 are arranged in the inlet and outlet regions of the drying chamber, and, for example, take the form of a series of metal sheets directed against the conveyor path 14. The distance between the length of material and the boundaries of the flow resistances facing the length of material is referenced D. The distance ratio between D and C (distance between material length and slot nozzle opening) is appropriately about 1 through 5:1. The calming effect which can be obtained with the flow resistances furthermore depends on the number of flow resistances 36 arranged in the direction of the conveyor path.

Although the invention has been described with reference to specific apparatus and specific process steps, the invention is only to be limited insofar as is set forth in the accompanying claims.

I claim:

1. In a process for drying of solvent containing material, in which the material is conducted through a drying chamber containing an inert gas, and in which inert gas is introduced into at least one lock chamber preceding and/or following the drying chamber, the improvement comprising: producing an annular flow of inert gas in the lock chamber by jetting a minor amount of the inert gas required for drying the material into the lock chamber in proximity to an opening of the drying chamber and a mixture of inert gas and sucked-in external air being discharged from the lock chamber in the peripheral region of the annular flow; and introducing the major portion of the inert gas directly into the drying chamber.

2. The process according to claim 1, wherein the major portion of the inert gas, after being laden with solvent vapors, is removed from the drying chamber and conducted back, after removal of the solvent vapors, into the drying chamber.

3. The process according to claim 1 or 2, wherein the volume ratio between the inert gas jetted into the lock chamber and the sucked-in external air is adjusted to about 1:1 to 1:400.

4. The process of claim 3 wherein said volume ratio is about 1:200.

5. In an apparatus for drying solvent containing material including a drying chamber containing inert gas; inlet and outlet openings in the drying chamber for passing material to be dried through the drying chamber; means for introducing inert gas into the drying chamber; and at least one lock chamber proximate an opening in the drying chamber; the improvement comprising said lock chamber having at least one slot nozzle proximate an opening in the lock chamber for jetting a minor amount of the inert gas required for drying the material to produce an annular flow of inert gas in the lock chamber; at least one suction opening in the lock chamber arranged in the peripheral region of the annular flow for discharging a mixture of inert gas and sucked-in outer air; and inlet and outlet ducts in the drying chamber for providing and withdrawing the major part of the inert gas for drying the material.

6. The apparatus according to claim 5, wherein the material to be dried is arranged on a conveyor conducted through the lock chamber and the drying chamber, and the inlet and outlet openings of the drying chamber and the lock chamber are constructed to be slit-shaped with adjustable slit width.

7. The apparatus according to claim 6, characterized in that the ratio of the width of at least one of the inlet or outlet slits of the drying chamber and the width of at least one of the inlet or outlet slits of the lock chamber is adjustable between about 1:0.20 and 1:5, preferably between about 1:0.3 and 1:3.

8. The apparatus according to claim 5, wherein the slot nozzles are adjustable at a setting angle between 5 and 90° to the length of material.

9. The apparatus according to claim 5, wherein the slit width of the slot nozzles is adjustable between about 0.1 and 2 mm.

10. The apparatus according to claim 5, wherein the ratio of the distances between the length of material and the slot nozzle opening to half the width of a slit of the drying chamber or half the width of a slit of a lock chamber is about 5 through 15:5 through 15:1, preferably about 10:10:1.

11. The apparatus according to claim 5, wherein the suction opening is in the end or roof wall of the lock chamber.

12. The apparatus according to claim 5, wherein flow resistances are arranged in the inlet region of the drying chamber.

13. The apparatus according to claim 5, wherein flow resistances are arranged at the outlet region of the drying chamber.

14. The apparatus according to claim 6, wherein the ratio of the distances between the length of material and the boundaries of the flow resistances facing the length of material, and between the length of material and the slot nozzle opening is about 1 through 5:1.

* * * * *